US011819099B2

(12) United States Patent
Bruchon et al.

(10) Patent No.: US 11,819,099 B2
(45) Date of Patent: Nov. 21, 2023

(54) DISPOSABLE PACKAGING FOR AT LEAST ONE CONTACT LENS

(71) Applicant: Constantia Pirk GmbH & Co. KG, Pirk (DE)

(72) Inventors: Pierre-Henri Bruchon, Vienna (AT); Stefan Frischmann, Vohenstrauss (DE); Wolfgang Eiber, Feucht (DE); Jörg Adrian, Griesheim (DE)

(73) Assignee: CONSTANTIA PIRK GMBH & CO. KG, Pirk (DE)

( * ) Notice: Subject to any disclaimer, the term of this patent is extended or adjusted under 35 U.S.C. 154(b) by 0 days.

(21) Appl. No.: 17/753,697

(22) PCT Filed: Sep. 8, 2020

(86) PCT No.: PCT/EP2020/075022
§ 371 (c)(1),
(2) Date: Mar. 11, 2022

(87) PCT Pub. No.: WO2021/048093
PCT Pub. Date: Mar. 18, 2021

(65) Prior Publication Data

US 2022/0330671 A1 Oct. 20, 2022

(30) Foreign Application Priority Data

Sep. 12, 2019 (EP) ..... 19197093

(51) Int. Cl.
*A45C 11/00* (2006.01)
*A45C 15/00* (2006.01)
(Continued)

(52) U.S. Cl.
CPC ..... *A45C 11/005* (2013.01); *A45C 15/00* (2013.01); *B65D 75/327* (2013.01); *B65D 81/22* (2013.01);
(Continued)

(58) Field of Classification Search
CPC ..... B65D 2575/3281; B65D 75/327; B65D 75/527; B65D 81/22; A45C 11/005; A45C 2011/006
(Continued)

(56) References Cited

U.S. PATENT DOCUMENTS 3,977,517 A * 8/1976 Kadlecik ..... A45C 11/005 206/5.1
5,620,087 A * 4/1997 Martin ..... B65B 25/008 206/820
(Continued)

FOREIGN PATENT DOCUMENTS

WO WO-2005006062 A1 * 1/2005 ..... A45C 11/005
WO 2013058711 A1 4/2013
(Continued)

OTHER PUBLICATIONS

International Preliminary Report on Patentability; Application No. PCT/EP2020/075022; dated Jul. 1, 2021; 12 Pages.
(Continued)

*Primary Examiner* — Chun Hoi Cheung
(74) *Attorney, Agent, or Firm* — Husch Blackwell LLP

(57) ABSTRACT

A disposable packaging for at least one contact lens. The disposable packaging has at least one molded structure which forms at least one product cavity for accommodating the contact lens. The molded structure has at least one cleaning chamber having a cleaning system for cleaning and/or disinfecting fingers. The cleaning system includes a cleaning pad which absorbs and holds cleaning and/or disinfecting agent, the cleaning pad being fixed in the cleaning chamber and the surface of said pad being exposed when the cleaning chamber is opened.

6 Claims, 7 Drawing Sheets

(51) Int. Cl.
*B65D 75/32* (2006.01)
*B65D 81/22* (2006.01)

(52) U.S. Cl.
CPC ..... *A45C 2011/006* (2013.01); *B65D 2575/3281* (2013.01)

(58) Field of Classification Search
USPC ..... 206/5.1, 223
See application file for complete search history.

(56) References Cited

U.S. PATENT DOCUMENTS 5,620,088 A * 4/1997 Martin ..... B65D 75/36 206/820
6,138,312 A * 10/2000 Cummings ..... A61L 12/086 15/104.93
6,364,098 B2 * 4/2002 Yavitz ..... G02C 13/008 15/104.92
7,938,255 B2 * 5/2011 Newman ..... B65D 75/28 206/5.1
2001/0017271 A1 8/2001 Yavitz
2013/0105335 A1 * 5/2013 Chavez, Jr. ..... A45C 11/005 206/5.1
2014/0331602 A1 * 11/2014 Newman ..... B29C 66/81463 53/422
2015/0114851 A1 * 4/2015 English ..... A45C 11/046 53/431
2019/0046353 A1 * 2/2019 Greenwood ..... A61F 9/0008

FOREIGN PATENT DOCUMENTS

WO 2014185354 A1 11/2014
WO 2017137738 A1 8/2017

OTHER PUBLICATIONS

International Search Report and Written Opinion of the International Searching Authority; Application No. PCT/EP2020/075022; Completed: Nov. 11, 2020; dated Nov. 23, 2020; 12 pages.

* cited by examiner

DISPOSABLE PACKAGING FOR AT LEAST ONE CONTACT LENS

TECHNICAL FIELD

The present teaching relates to disposable packaging for at least one contact lens, the disposable packaging having at least one molded structure which forms at least one product cavity for accommodating the contact lens, which product cavity is closed by a first closure member that can be opened by the user, and the molded structure having at least one cleaning chamber that is closed by the first closure member and/or a further closure member that can be opened by the user.

BACKGROUND

Single-use contact lenses are gaining in popularity due to their consumer-friendly properties. Various types of disposable packaging are commonly used to package such contact lenses and are disposed of after the contact lens(es) stored therein has/have been removed. The disposable packaging can, for example, have a molded structure in which the product cavity/cavities are formed as so-called blisters. The product cavity can be sealed by a film-like closure member, which can usually contain an aluminum layer as a barrier layer. In order to remove the contact lens, the closure member is pulled off a tab, for example, in order to open the product cavity and remove the contact lens with the finger and insert it into the eye.

Although the contact lens is typically stored in the product cavity in a sterile storage solution, contact with the finger can transfer germs and foreign objects to the contact lens, which can then get into the eye and cause inflammation and disease.

WO 17137738 A1 discloses a system that allows the contact lens to be gripped with a "clean" finger. A sterile adhesive film is provided, which is applied to the fingertip before the contact lens is gripped, so that the finger does not come into direct contact with the contact lens. However, applying the film requires some skill and the film can be perceived as annoying by the user, since it can impair the sensitive tactile perception of the fingertip.

SUMMARY

One object of the present teaching is to provide packaging products for contact lenses which allow the contact lens to be inserted with the finger with little risk and which allow easy use.

These and other objects are achieved according to the present teaching by a disposable packaging of the type mentioned at the outset, a cleaning system for cleaning and/or disinfecting fingers being arranged in the cleaning chamber, the cleaning system comprising a cleaning pad which absorbs and holds cleaning and/or disinfecting agent, and the cleaning pad being fixed in the cleaning chamber and the surface of said pad being exposed when the cleaning chamber is opened. Such a cleaning pad fixed in the cleaning chamber allows easy and reliable cleaning of the fingertip with which the contact lens is to be picked up. The disposable packaging can be handled easily because it can be held with one hand. The fingers of the free hand remain free and can be used to handle the contact lens. In particular, no other part, apart from the contact lens, has to be handled with the free hand. The user can therefore easily and quickly clean his finger before taking out the contact lens.

The cleaning pad can consist, for example, of an open-pored plastics material, a textile material, a porous sponge material, a fleece material or a similar material that is impregnated with the cleaning and/or disinfecting agent. As a result, the cleaning and/or disinfecting agent cannot leak out of the cleaning chamber after it has been opened. In addition, the finger can be wiped on the cleaning pad, which improves the cleaning effect due to the additional mechanical cleaning.

Advantageously, the first closure member and/or the further closure member are sealed onto the molded structure by thermosealing. It is particularly advantageous if the seal between the closure member and the molded structure is designed to be peelable on a first portion and is designed as a fixed seal on a second portion. It can thus be ensured that the closure member remains on the molded structure after opening, which makes it easier to handle the used disposable packaging because fewer individual parts remain. In addition, the thus larger opened disposable packaging can also make it possible to recycle the used disposable packaging because it can be accessible to a mechanical sorting of a recycling process.

The contact lens is particularly advantageously arranged in the product cavity with the curvature towards the opening of the product cavity, and therefore it can be picked up in the correct alignment with the cleaned fingertip.

In a further advantageous embodiment, the product cavity and the cleaning chamber can be arranged on one side of the molded structure. The product cavity and the cleaning chamber can be closed, for example, with a single closure member, for example a closure film, which can be pulled off by the user with one hand movement. Furthermore, this also allows a stacked arrangement of the prefabricated molded structures before packaging and reduces the transport volume.

On the other hand, the product cavity and the cleaning chamber can be arranged on opposite sides of the molded structure, which allows a particularly space-saving design of the disposable packaging. After the cleaning chamber is opened to clean the finger, the disposable packaging can be turned over to open the product cavity and take out the contact lens with the cleaned finger. This also makes it possible for the molded structures consisting of several parts to be delivered individually and to be combined with one another to form the relevant molded structure only during the course of the packaging process.

Advantageously, the molded structure can have at least one plastics film molded part, into which the product cavity and/or the cleaning chamber is introduced in the manner of a blister contour. Blister packs are particularly suitable for carrying out the present teaching on an industrial scale because of their advantageous properties and the low-cost production method. Optionally, multiple plastics film molded parts can be combined to allow for more complex shapes, such as a molded structure formed on both sides.

The present teaching further relates to a collective packaging for a plurality of contact lenses, which collective packaging has a plurality of disposable packagings which are preferably detachably connected to one another. The collective packaging can be designed, for example, in the manner of a tablet blister, which includes a flat arrangement of the individual disposable packagings. The disposable packaging can, for example, be torn off or broken off the collective packaging at the weakening lines provided, so that the user can use it as individual packaging.

BRIEF DESCRIPTION OF THE DRAWINGS

The present teaching is explained in more detail below with reference to FIGS. 1 to 10, which show schematic and non-restrictive advantageous embodiments of the present teaching by way of example. In the drawings.

DETAILED DESCRIPTION

Figure 2:
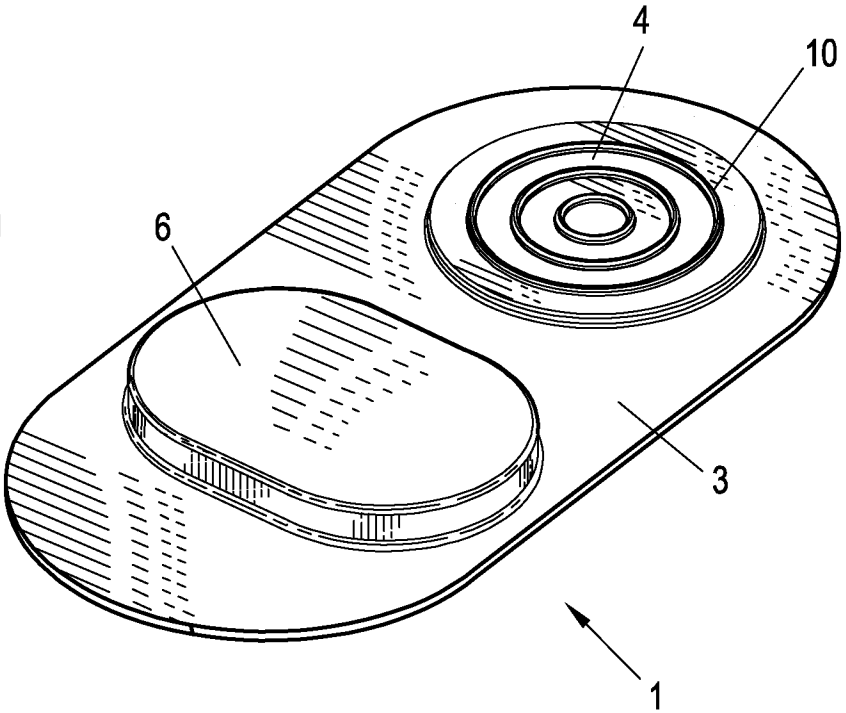
FIG. 2 shows a disposable packaging according to the present teaching seen from below.
Figure 1:
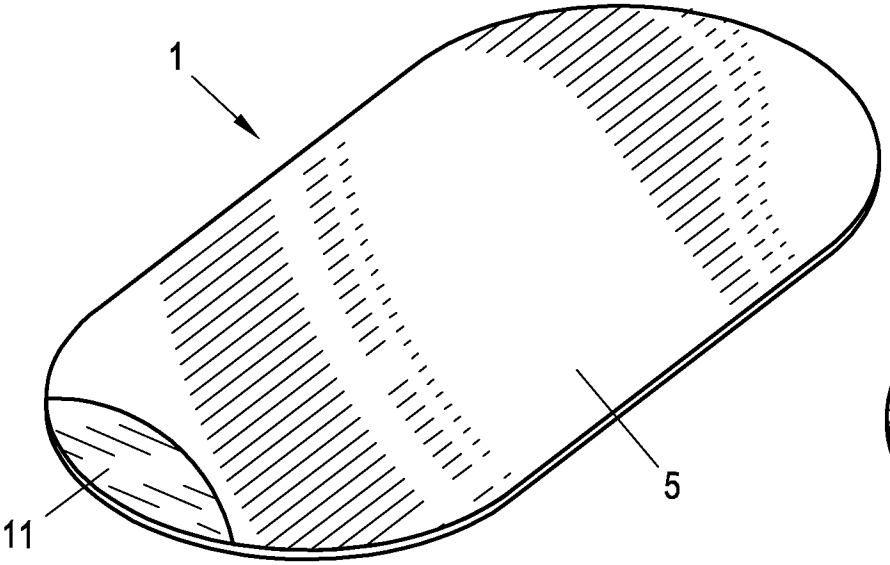
FIG. 1 is a diagrammatic representation of a disposable packaging according to the present teaching according to a first embodiment in the closed state, seen from an upper side.

In FIGS. 1 and 2, a disposable packaging 1 according to the present teaching is shown in a view from above and in a view from below, respectively. The disposable packaging 1 substantially consists of a molded structure 3 into which a product cavity 4 and a cleaning chamber 6 are introduced. The molded structure 3 can be made, for example, from a plastics film molded part, in particular from a mono- or multi-layer film composite, into which the product cavity 4 and the cleaning chamber 6 are introduced, for example by thermoforming or cold forming, in the manner of a blister pack. The outer contours of the cleaning chamber 6 and the product cavity 4 are shown in FIG. 2.

The terms "top" and "bottom" are chosen in connection with the present disclosure purely for reasons of description and are in no way to be interpreted as restrictive. The side toward which the product cavity 4 opens is generally referred to as "top."

The cleaning chamber 6 and the product cavity 4 are closed at the top (FIG. 1) by a closure member 5. The closure member 5 is designed as a single cover plate that matches the size and shape of the molded structure, which is sealed onto the surface of the molded structure 3 in a manner known per se and covers and closes the product cavity 4 and the cleaning chamber 6. The closure member 5 can, for example, be an optionally printed and/or embossed aluminum foil, the inside of which is coated with a sealing layer. Optionally, any plastics composite materials (with or without an aluminum layer) which are known in the prior art for such purposes can be used as the closure member 5.

The closure member 5 has a tab 11 on one side where the closure member 5 is not sealed to the molded structure 3. The closure member 5 can be grasped by the user at this tab 11 and peeled off to open the disposable packaging. Corresponding sealing systems that allow such peeling are known in the art.

Figure 3:
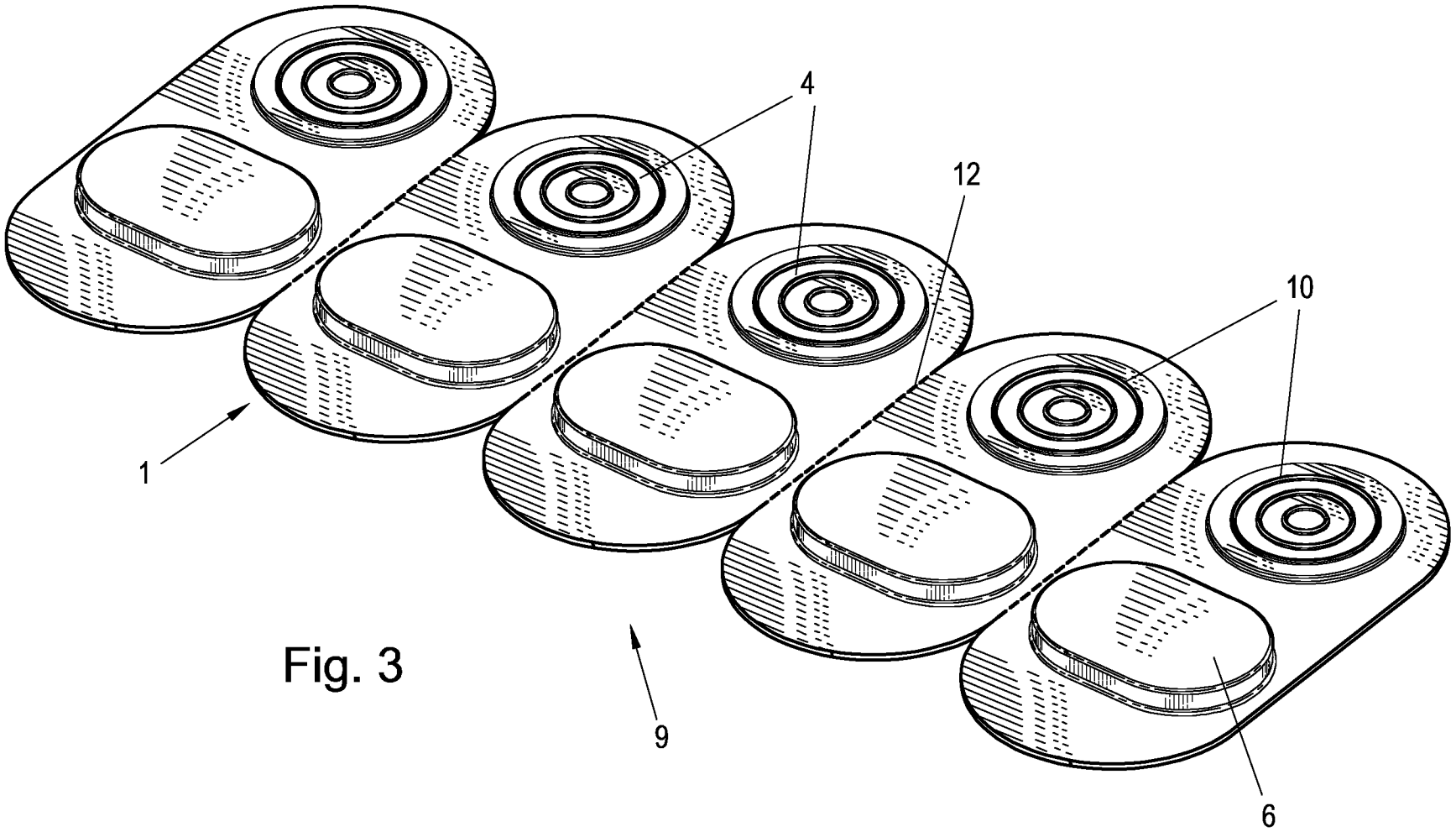
FIG. 3 is a diagrammatic representation of a collective packaging that comprises a plurality of disposable packagings.

FIG. 3 shows a collective packaging 9, which consists of five disposable packagings 1 in the illustrated case, which are produced in the form of a cohesive blister pack. The individual disposable packagings 1 are delimited from one another by weakening lines 12 along which the packaging material can be broken or torn apart in order to separate the individual disposable packagings 1 from one another.

The use of the disposable packagings 1 according to the present teaching is explained below with reference to FIGS. 4 to 6.

Figure 4:
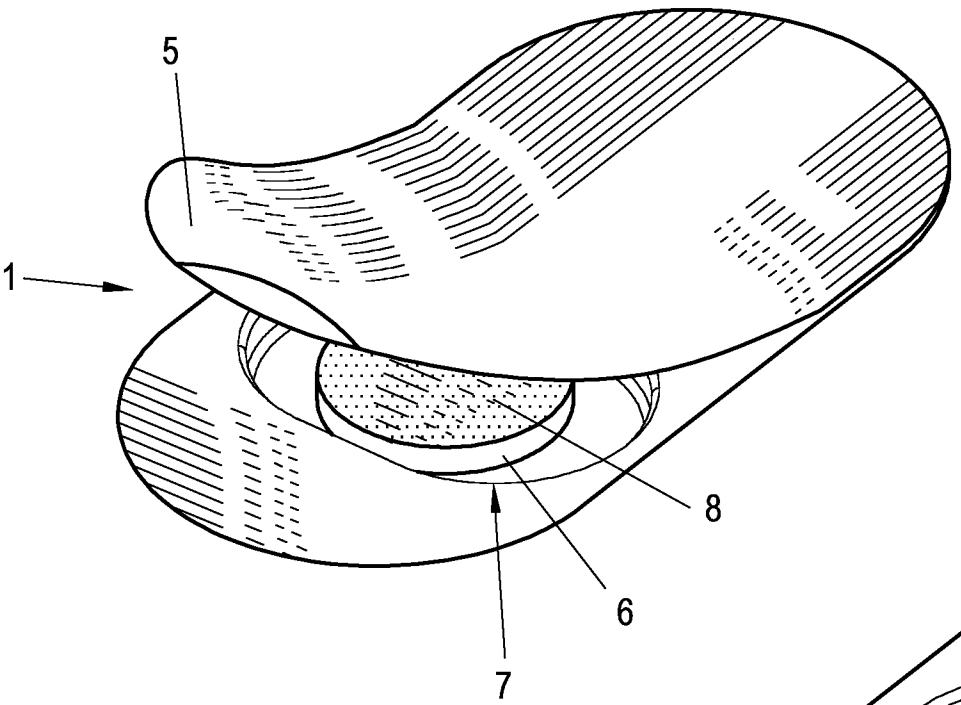
FIG. 4 shows a disposable packaging according to the present teaching in a partially opened configuration, with a cleaning chamber being exposed.

FIG. 4 shows a disposable packaging 1 according to the present teaching, which corresponds to the representation in FIGS. 1 and 2, with the closure member 5 being retracted approximately halfway, so that the cleaning chamber 6 is open while the product cavity 4 lying therebehind remains closed. The cleaning chamber 6 contains a cleaning system 7, which substantially consists of a cleaning pad 8 impregnated with a cleaning and/or disinfecting agent, which cleaning pad is placed in the cleaning chamber 6 and the surface of which is exposed when the cleaning chamber is opened. The surface of the cleaning pad 8 is large enough to clean a fingertip.

The cleaning pad 8 absorbs and holds the cleaning and/or disinfecting agent for cleaning or disinfecting fingers.

The cleaning pad 8 can be made of an open-pored plastics material, a textile material, a porous sponge material, a fleece material, or a similar material, for example in the form of a woven fabric, a knitted fabric, a braided fabric, a mesh, a fleece, a felt or the like, which is capable of absorbing and holding cleaning and/or disinfecting agent.

The cleaning pad 8 can also be designed as a dimensionally stable gel. A dimensionally stable gel is understood to be a gel that consists of a polymer matrix that absorbs liquid cleaning and/or disinfecting agent without losing its material cohesion. The polymer matrix can swell as a result of the liquid cleaning and/or disinfecting agent. The liquid cleaning and/or disinfecting agent is held in the polymer matrix.

The cleaning pad 8 ensures that the fingertip to be cleaned can be rubbed mechanically on the cleaning pad 8 in order to allow mechanical cleaning, for example removing flakes of skin. The cleaning and/or disinfecting agent also inactivates or destroys microorganisms on the fingertip and cleans them.

The cleaning pad 8 is fixed in the cleaning chamber 6 in order to carry out the cleaning of the fingertip in order to prevent the cleaning pad 8 from falling out, for example due to the disposable packaging 1 tipping over, or being removed (apart from forcible removal). The fixing can be form-fitting, for example by the interlocking of at least two connection partners, one connection partner being provided in the cleaning chamber 6 and the other connection partner being provided on the cleaning pad 8, or integral, for example by gluing. Gluing can also include a thermal process in which the underside of the cleaning pad 8 is melted if a suitable material is used and is pressed against the base of the cleaning chamber 6, so that after the underside has solidified again, an integral connection with the cleaning chamber 6 is created.

Figure 5:
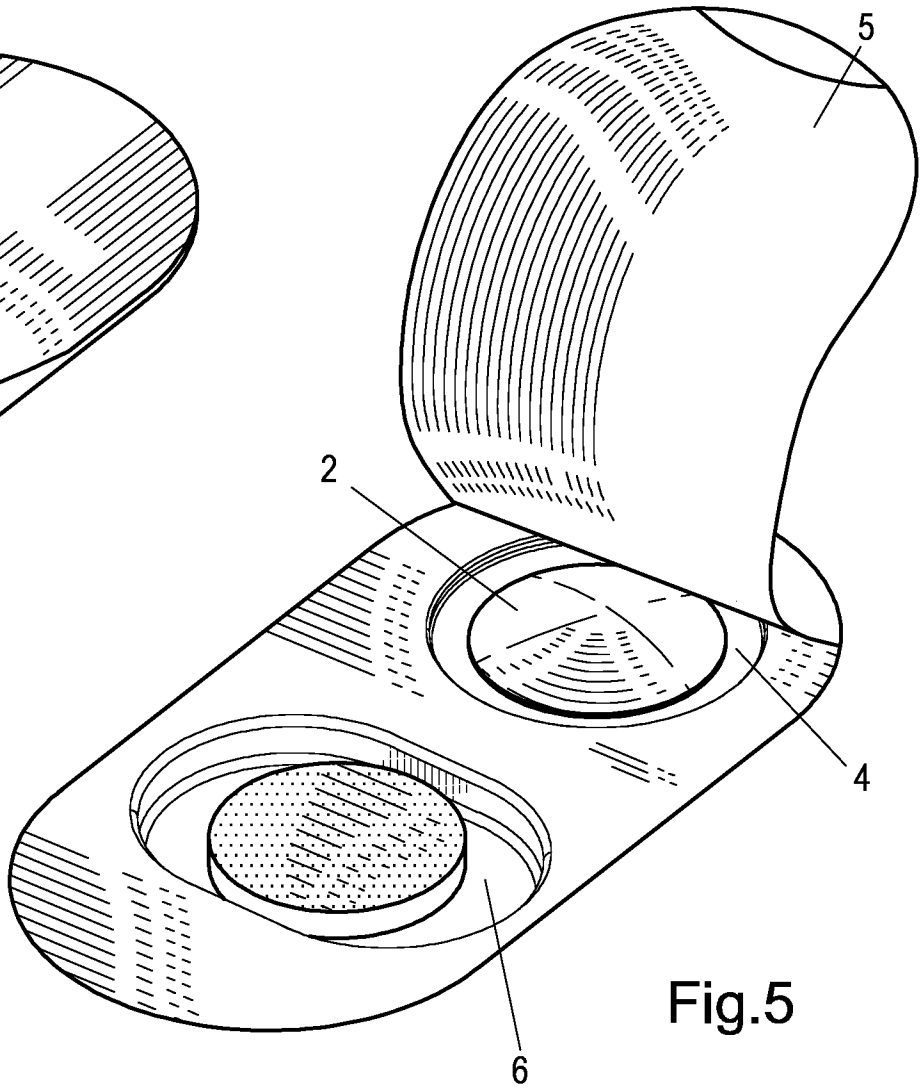
FIG. 5 shows the disposable packaging according to the present teaching in a further opened configuration, with the product cavity also being accessible.

FIG. 5 shows the disposable packaging 1 of FIG. 4, the closure member 5 having been peeled further in order to also open the product cavity 4 in which a contact lens 2 is arranged. The product cavity 4 can be filled with an eye-compatible disinfectant in a known manner in order to store the contact lens 2, as is known in the art. The product cavity 4 can form a rib pattern 10 (as in FIG. 2) on which the contact lens 2 rests, with the curvature of the contact lens 2 being directed towards the opening (i.e., upward). Depending on customer requirements, the product cavity 4 can also form other non-planar structures instead of the rib pattern 10, such as indentations, gratings, grids, holes, etc.

Figure 6:
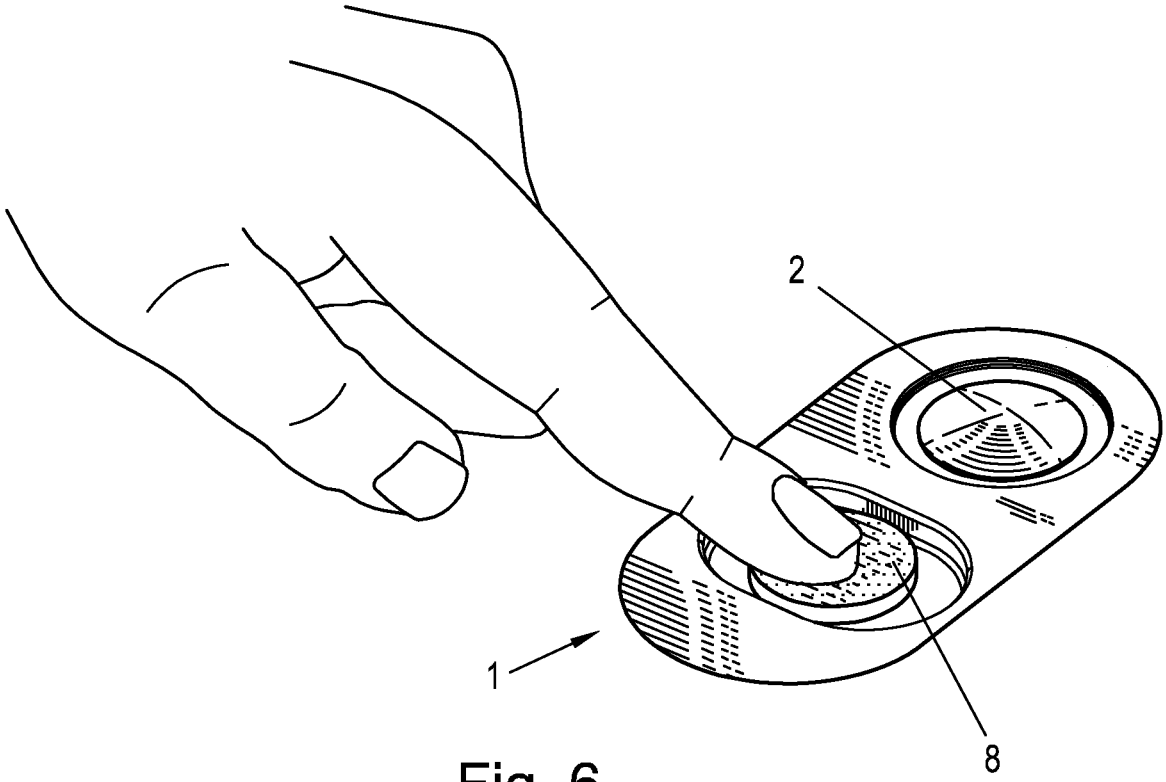
FIG. 6 shows a fully opened disposable packaging according to the present teaching after the closure member has been removed.

In order to remove the contact lens 2 and insert it into the eye, the closure member 5 can be peeled off until the cleaning chamber 6 and the product cavity 4 are open; if necessary, the closure member can also be completely peeled off and removed, as shown in FIG. 6. Before grasping the contact lens 2, the fingertip can be wiped on the cleaning pad 8 and thereby cleaned or disinfected. Thereafter, the contact lens 2 is touched with the cleaned fingertip. Due to the adhesion forces mediated by the moisture in the contact lens 2, the contact lens 2 adheres to the fingertip and can thus be removed from the product cavity 4 and inserted into the eye.

After the curvature of the contact lens 2 is preferably directed towards the opening of the product cavity 4, it is simultaneously ensured that the contact lens is picked up with the cleaned fingertip on the correct side or can be inserted into the eye with the correct side first.

In the embodiment described above, only a single closure member 5 is shown and described, which closes both the cleaning chamber 6 and the product cavity 4. However, a plurality of closure members, for example a first closure member 5 for the cleaning chamber 6 and a further closure member 5' for the product cavity, can also be provided.

It can also be provided that the closure member 5 can only be peeled off from one side, in particular on the side of the cleaning chamber 6. A tab 11 on this side, for example on the side of the cleaning chamber 6 as in FIG. 4 or 5, can ensure this.

However, it can also be provided that a closure member 5 is sealed onto the molded structure 3 only in portions with a peelable seal and in another portion with a fixed seal that cannot be separated without being destroyed. The closure member 5 cannot therefore be peeled off at the fixed seal. For example, the closure member 5 could be sealed to the molded structure 3 at the side of the product cavity 4 with a fixed seal and along the remaining portion of the periphery of the closure member 5 with a peelable seal. The closure member 5 can thus only be peeled off the side of the cleaning chamber 6 as far as the fixed seal on the side of the product cavity 4.

However, the provision of a fixed seal on a portion of the periphery of the closure member 5 also has another advantage. The fixed seal can ensure that, at least when the disposable packaging 1 is used normally, the closure member 5 remains on the molded structure 3 after the disposable packaging 1 has been opened. This can also facilitate the recycling of the used disposable packaging 1 or make it possible in the first place. Plastic waste is usually initially mechanically sorted in a recycling process. However, plastic waste that is too small is already separated out in advance and removed as non-recyclable residual waste. Only pieces of plastic waste that are large enough are sorted. If the closure member 5 remains on the molded structure 3, the open disposable packaging 1 is larger and can be sorted and subsequently recycled.

A further embodiment of the disposable packaging according to the present teaching is shown in FIGS. 7 to 10, the product cavity 4 and the cleaning chamber 6 being arranged on opposite sides.

Figure 7:
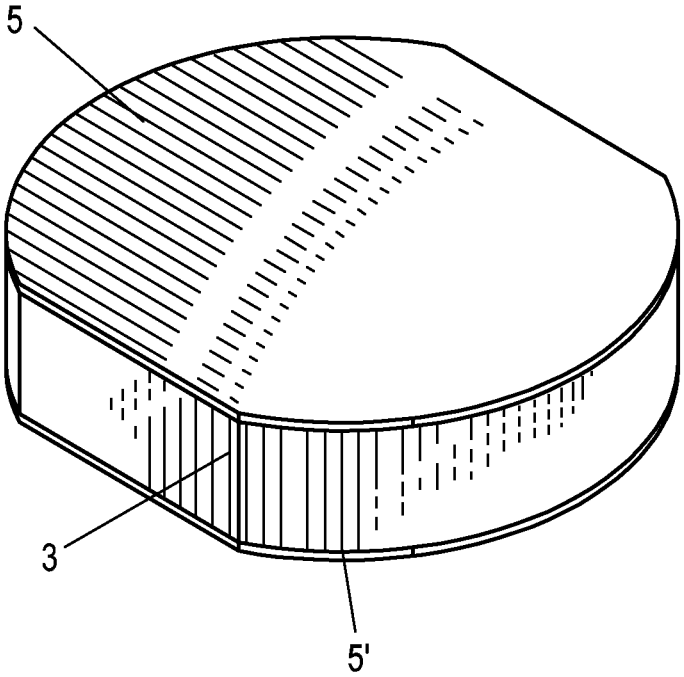
FIG. 7 is a diagrammatic representation of a disposable packaging according to the present teaching according to a further embodiment in the closed state, seen from an upper side.

The disposable packaging 1 shown in FIG. 7 has a molded structure 3 in the form of a plastics blister with functional shaped portions on both sides. The molded structure 3 has a product cavity 4 on its upper side which is closed by a first closure member 5. Furthermore, the molded structure 3 has a cleaning chamber 6 on the opposite (i.e., the "lower") surface which is closed by a further closure member 5'. The designations "top" and "bottom" are in turn related purely to the representation in the figures and are not to be interpreted as restrictive.

The molded structure 3 can, for example, be made up of two plastics molded parts, into which the corresponding shaped portions (i.e., in particular the product cavity 4 and the cleaning chamber 6) are introduced by thermoforming. The two plastics molded parts can then be joined together to form the approximately can-like, double-sided shape of the molded structure shown in FIG. 7.

Figure 8:
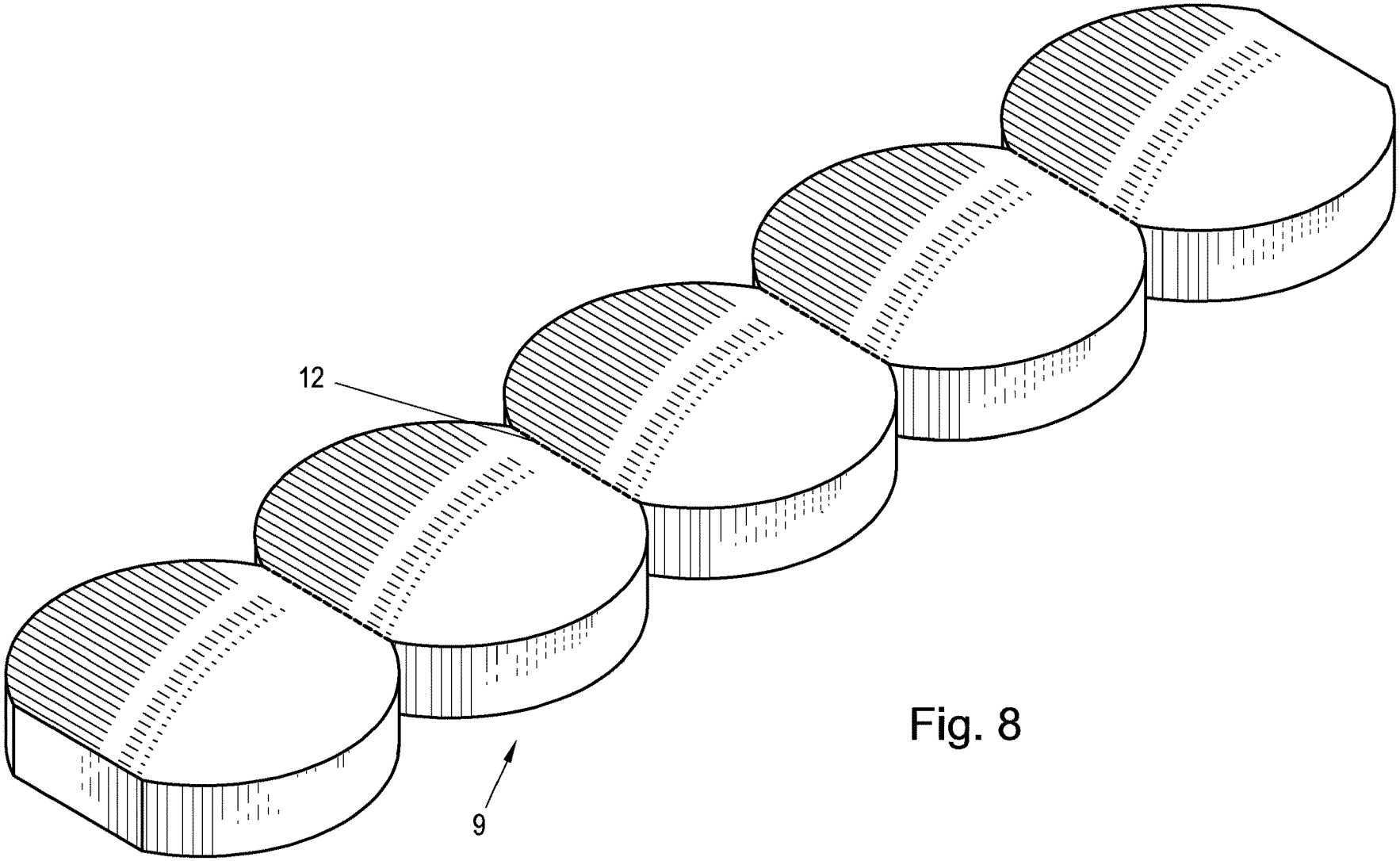
FIG. 8 is a diagrammatic representation of a collective packaging that comprises a plurality of disposable packagings.

FIG. 8 shows a collective packaging 9, which consists of a plurality of disposable packagings 1 according to FIG. 7 attached to one another. The individual disposable packagings 1 of the collective packaging 9 can in turn be broken or torn apart at weakening lines 12.

Figure 9:
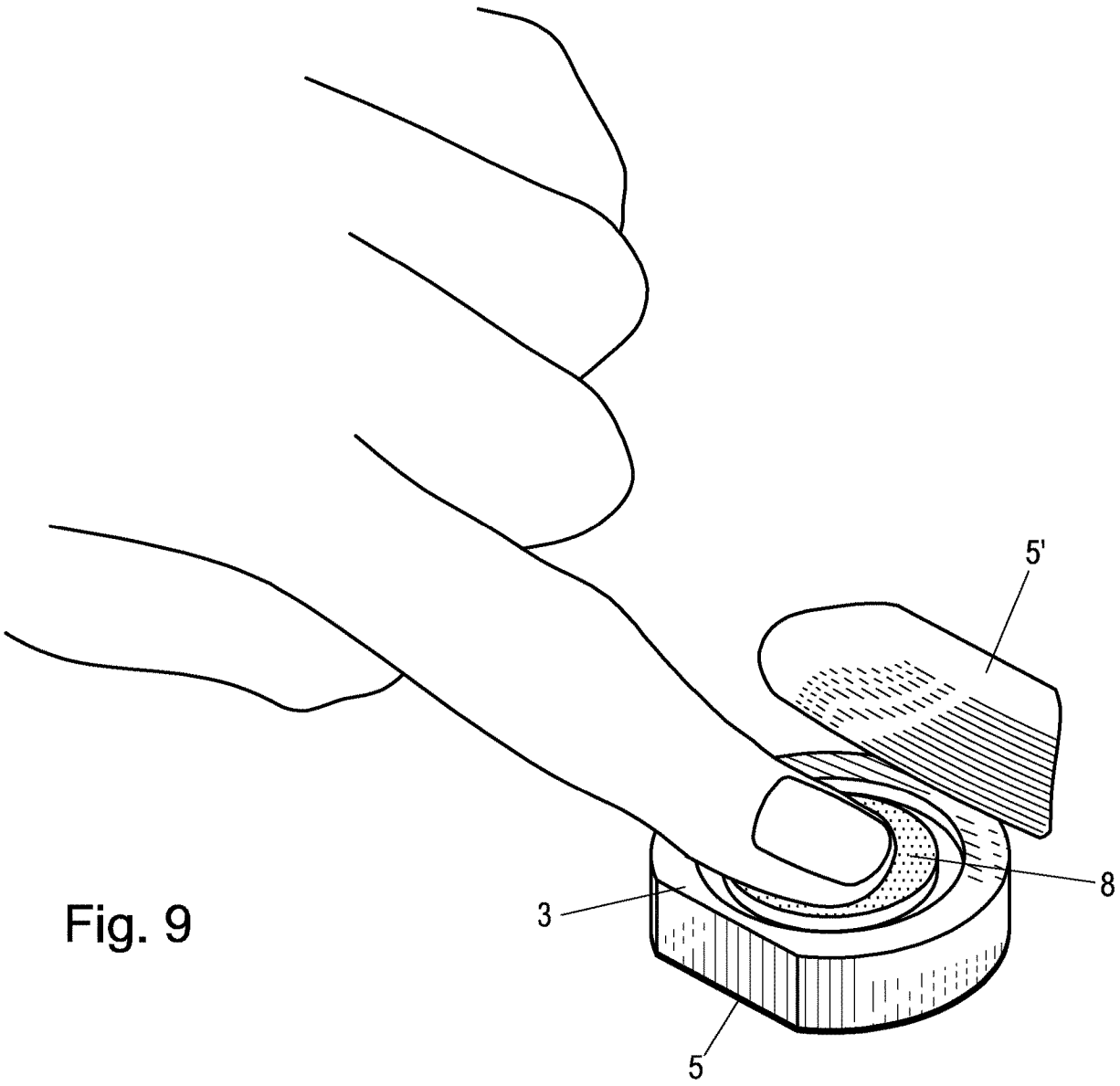
FIG. 9 shows a partially opened disposable packaging according to the present teaching, with a cleaning chamber being accessible.
Figure 10:
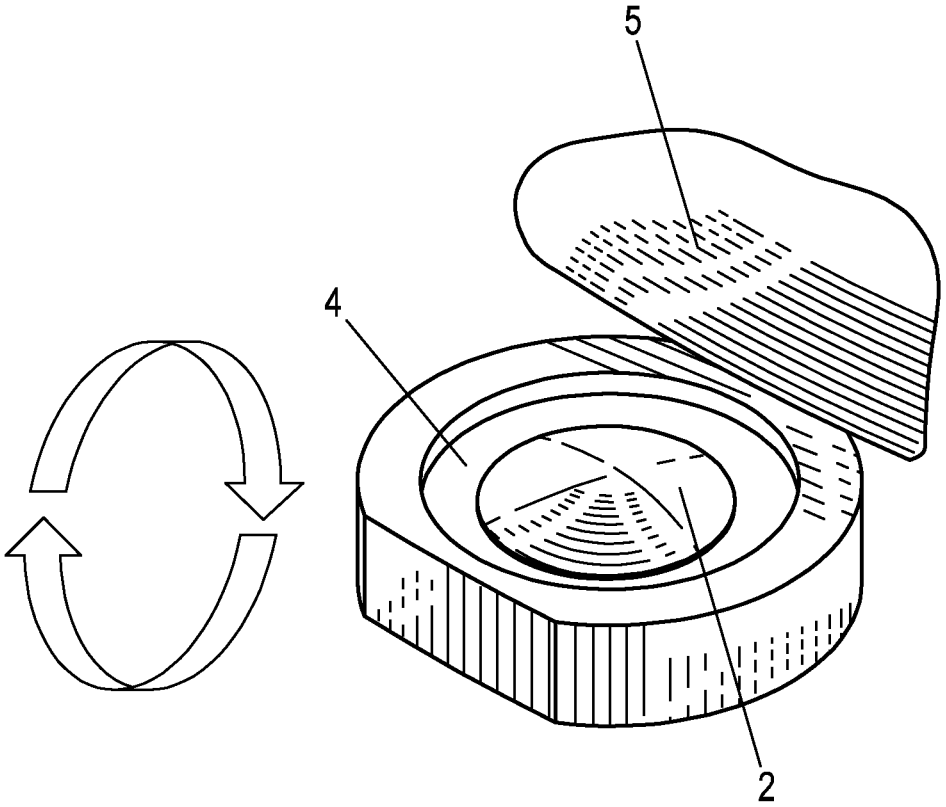
FIG. 10 shows a partially opened disposable packaging according to the present teaching, with the product cavity being accessible.

The use of the disposable packaging 1 formed on both sides is shown in FIGS. 9 and 10. First, the "underside" of the disposable packaging 1 is opened by peeling off the additional closure member 5' and the fingertip can be cleaned and/or disinfected with the cleaning system 7 thus exposed. Thereafter, the disposable packaging 1 is turned over (FIG. 10) so that the side of the product cavity 4 is arranged on top and the first closure member 5 is opened. The contact lens 2 located in the product cavity 4 can then be removed with the cleaned fingertip and inserted into the eye.

In this embodiment, too, the cleaning system 7 can comprise a cleaning pad 8 as described above, which is fixed in the cleaning chamber 6. Likewise, the closure members 5, 5' can be sealed as described above, i.e. with a peelable and fixed seal.

The invention claimed is:

1. A disposable packaging including at least one contact lens, the disposable packaging having at least one molded structure which forms at least one product cavity for accommodating the at least one contact lens, the at least one contact lens being arranged in the at least one product cavity with the curvature towards the opening of the at least one product cavity, the at least one product cavity with at least one contact lens arranged therein being closed by a first closure member that is configured to be opened by the user, and the at least one molded structure having at least one cleaning chamber that is closed by the first closure member or a further closure member that is configured to be opened by the user, wherein a cleaning system for cleaning or disinfecting fingers is arranged in the at least one cleaning chamber, the cleaning system including a cleaning pad which absorbs and holds and is impregnated with a cleaning or disinfecting agent prior to the first or further closure members being opened by the user, and the cleaning pad being fixed in the at least one cleaning chamber and the surface of said pad being exposed when the at least one cleaning chamber is opened.

2. The disposable packaging according to claim 1, wherein the first closure member or the first closure member and the further closure member are sealed onto the at least one molded structure, the seal being peelable on a first portion and being designed as a fixed seal on a second portion.

3. The disposable packaging according to claim 1, wherein the at least one product cavity and the at least one cleaning chamber are arranged on one side of the at least one molded structure.

4. The disposable packaging according to claim 1, wherein the at least one product cavity and the at least one cleaning chamber are arranged on opposite sides of the at least one molded structure.

5. The disposable packaging according to claim 1, wherein the at least one molded structure has at least one mono- or multi-layer film composite, into which at least the at least one product cavity or the at least one cleaning chamber is introduced in the manner of a blister contour.

6. A collective packaging for a plurality of contact lenses, wherein the collective packaging has a plurality of disposable packagings according to claim 1, the packagings detachably connected to one another.

* * * * *